US005555760A

United States Patent [19]

Kadis

[11] Patent Number: 5,555,760

[45] Date of Patent: Sep. 17, 1996

[54] ACTUATOR-PUNCH ASSEMBLY WITH FORMING DIE INSTALLATION

[76] Inventor: Paul M. Kadis, 9685 Fox Meadow, Chardon, Ohio 44024

[21] Appl. No.: 234,326

[22] Filed: Apr. 28, 1994

[51] Int. Cl.[6] ..... B21D 28/24

[52] U.S. Cl. ..... 72/334; 72/453.18; 92/183

[58] Field of Search ..... 72/453.18, 453.01, 72/334, 333, 328; 92/110, 108, 181 P, 183; 60/453

[56] References Cited

U.S. PATENT DOCUMENTS

| | | | |
|---|---|---|---|
| 3,077,865 | 2/1963 | Hart | 92/110 |
| 3,752,040 | 8/1973 | Pawloski | 92/110 |
| 4,409,884 | 10/1983 | Boehringer | 92/108 |
| 4,571,975 | 2/1986 | Pawloski | 72/453.18 |
| 4,791,854 | 12/1988 | Banicevic | 92/108 |
| 5,353,682 | 10/1994 | Sulprizio | 92/110 |

FOREIGN PATENT DOCUMENTS

| | | | |
|---|---|---|---|
| 102620 | 3/1984 | European Pat. Off. | 72/334 |
| 1134956 | 8/1962 | Germany | 72/334 |
| 2833626 | 2/1980 | Germany | 72/453.18 |
| 412018 | 1/1974 | U.S.S.R. | 72/334 |
| 1657268 | 6/1991 | U.S.S.R. | 72/334 |

*Primary Examiner*—Daniel C. Crane
*Attorney, Agent, or Firm*—John R. Benefiel

[57] ABSTRACT

A forming die set has one or more independently operated hydraulic punch assemblies mounted directly in one of the die shoes to enable a programmed piercing pattern to be carried out at the time the workpiece is formed. Each punch assembly includes a compact self contained actuator, punch holder, stripper plate and punch retainer, with supply and return connections both made at one end of a cylinder housing with a return flow path through a tube extending through the piston. A purging system using a check valve in the supply line establishes an incremental flow back to the reservoir eliminate air bubbles. An accumulator having a charge volume detector is used to operate the punch assembly actuator.

9 Claims, 5 Drawing Sheets

ACTUATOR-PUNCH ASSEMBLY WITH FORMING DIE INSTALLATION

BACKGROUND OF THE INVENTION

1. Field of the Invention

This invention concerns punching tools and actuators therefor, particularly adapted for piercing holes in die formed sheet metal workpieces.

2. Description of the Prior Art

Die forming of sheet metal in a press is a very common process for manufacturing such parts as automotive body parts, appliance panels, etc. It is often necessary to form holes in the formed workpiece by a secondary piercing operation. One method for carrying out such secondary operation has been the mechanical driving of a punch with a cam mechanism operated by the die press operation, with return springs stripping the punch after the workpiece has been pierced.

A disadvantage of this approach is that there often arises situations where holes are required only with some of the die-formed workpieces, or holes are needed in different locations on different runs of workpieces.

In these cases, disabling or activating a particular punching mechanism requires time consuming installation or removal of the punch mechanisms.

The press ram stroke necessary for operation of the punch mechanisms makes it impossible to carry out forming and piercing in the same station, necessitating a separate station and further part handling.

Sometimes the hole locations necessitate particularly complicated arrangements to execute piercing the holes with a mechanical drive.

Another approach has been to provide hydraulically operated punches, with these units installed on the bed of a fixture. This also requires an additional station, necessitating more plant floor space and further part handling to load and unload the same.

Sometimes, die designers have used off-the-shelf cylinders, which results in a bulky, complex installations.

While specially designed hydraulic piercing devices have been developed to provide simpler and more compact installations, these have not alleviated the need for a separate station.

Another problem in hydraulic punch installations has involved the elimination of air bubbles which can require disassembly and bleeding through the fittings, as there is no other way for air bubbles to be eliminated due to the long lines between the reservoir and the punch actuators.

A further problem is encountered in accumulator type hydraulic pressure sources, in that there is sometimes insufficient available volume, despite a sensed adequate pressure level.

The hydraulic cylinder installations have been bulky in part because of the need to provide hydraulic connections to each side of the cylinder piston, necessitating a fitting projecting from the side of the cylinder.

Accordingly, it is an object of the present invention to provide an arrangement for punching formed workpieces which is readily programmable and which allows punching to be carried out in the same station as the forming step.

It is a further object to provide a hydraulical punch and actuator assembly for such arrangement which is particularly compact.

It is yet another object to provide a hydraulic punch actuator which can eliminate air bubbles without bleeding of the lines, and an accumulator type pressure source in which it is assured that a sufficient volume of pressurized fluid is available to operate the punch actuators.

SUMMARY OF THE INVENTION

These objects are achieved by a compact cylindrical hydraulic actuator-punch assembly which is installed directly in the forming die so as to enable the punching operations to be performed in the same station as the station where die forming of the workpiece occurs.

The actuator-punch assembly comprises a housing cylinder enclosing a piston and piston rod coupled to a punch retainer slidable in the housing cylinder. A punch is held in the punch retainer and a return spring is also enclosed by the housing cylinder, with a stripper cap mounted to the end thereof.

Supply and return hydraulic flow paths both extend axially to the upper end of the assembly by use of a retract flow tube extending through the piston and receiving flow from the return side of the piston through a series of radial passages in the piston rod.

A check valve creates a net flow back to the reservoir with stroking of the piston to progressively eliminate air bubbles to eliminate the need for bleeding of the system.

The hydraulic pressure source preferably comprises an accumulator charged with an air pressure intensifier, a limit switch used to provide a control signal corresponding to the fully charged condition of the accumulator.

DETAILED DESCRIPTION

In the following detailed description, certain specific terminology will be employed for the sake of clarity and a particular embodiment described in accordance with the requirements of 35 USC 112, but it is to be understood that the same is not intended to be limiting inasmuch as the invention is capable of taking many forms and variations with the scope of the appended claims.

Figure 1:
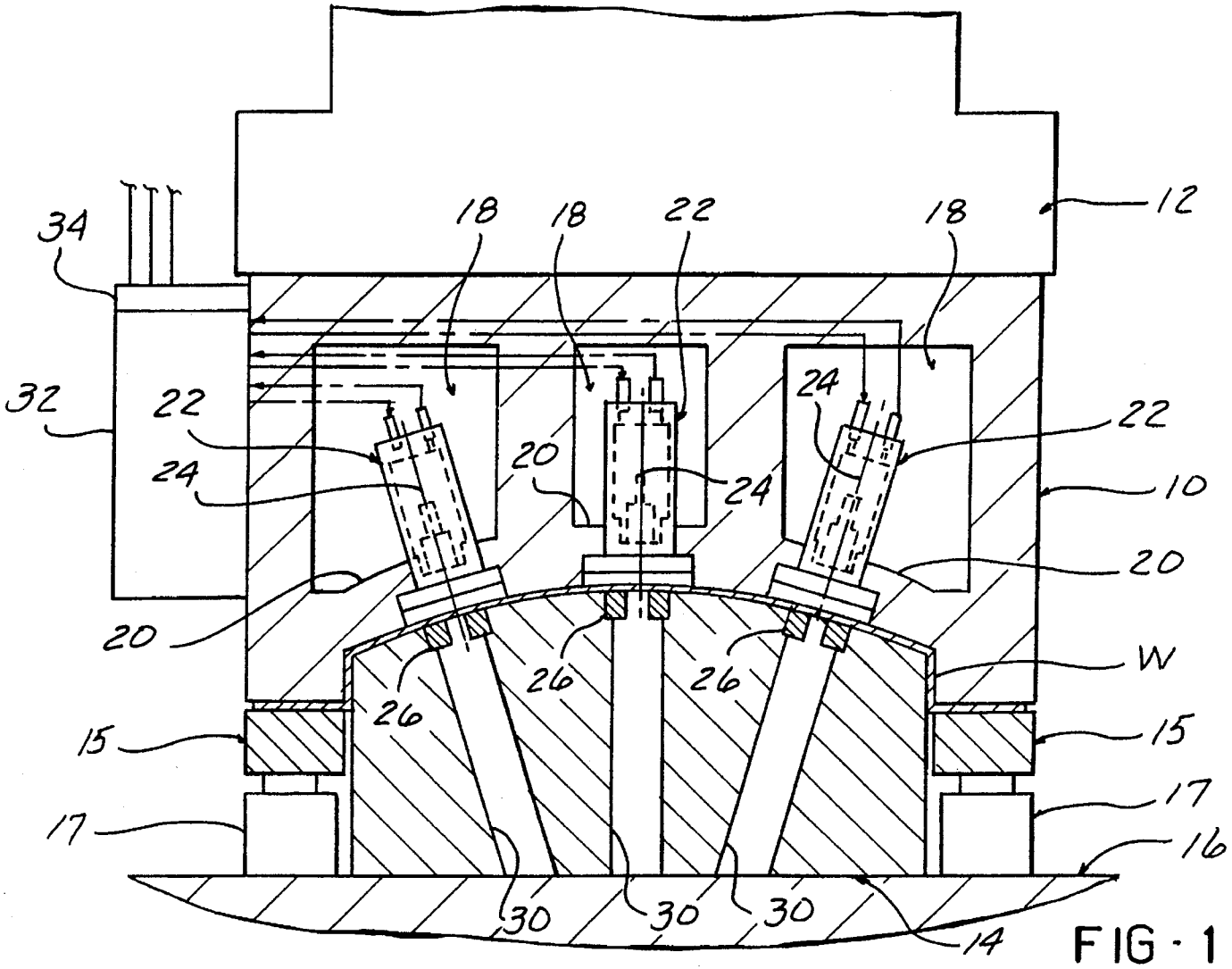
FIG. 1 is a cross-sectional view through a forming die showing the installation therein of three actuator-punch assemblies according to the present invention, and a diagrammatic representation of the associated hydraulic valving and connections.

Referring to the drawings, and particularly FIG. 1, a die installation is shown incorporating a series of hydraulic actuator-punch assemblies 22 according to the concept of the present invention. The die installation includes an upper die 10 secured to be advanced by a press ram 12 to form a workpiece W against a lower die 14 mounted on the press bed 16. A draw ring 15 is sometimes used urged against the outer perimeter of the workpiece W by nitrogen springs 17 as the forming operation proceeds.

The upper die 10 is typically formed with lightening cavities 18. According to the concept of the invention, the lower wall 20 defining each of the cavities 18 is counterbored to receive a generally cylindrical actuator-punch assembly 22.

Each actuator punch assembly 22 is provided with a punch tool as described hereinafter in further detail which is advanced along a center line 24 to be driven through the workpiece W just as the forming operation formed between an upper die 10 and the lower die 14 is completed. A punch die 26 is recessed into a counterbore in the lower die 14 aligned with the centerline 24 such as to receive the punching tool after piercing the workpiece W.

The lower die 14 is formed with aligned bores 30 to receive the slugs resulting from the punching process.

Each of the actuator-punch assemblies 22 is hydraulically operated and a valve manifold 32 may be mounted to the upper die 10 providing hydraulic connections to each actuator punch assembly 22 by suitable hydraulic lines.

A manifold quick connect/disconnect coupling 34 may be provided to connect the external manifold 32 to an external hydraulic pressure source. Such manifold, quick connect coupling is not described herein in detail, inasmuch as such equipment is commercially available, such as from Cejn Industrial Corporation of Niles, Ill. or Parker Hannitan of Cleveland, Ohio.

Such quick connection coupling systems allow connections for hydraulic and electrical, as well as air pressure lines by a single manifold member. Alternatively, the entire hydraulic circuit and pressure source to be described may be mounted to the upper die, so that only electrical control lines are necessary. The various lines connected to the quick connect coupling 34 should be mounted to accommodate the reciprocating motion of the upper die by the movement of the press ram 12.

Figure 2:
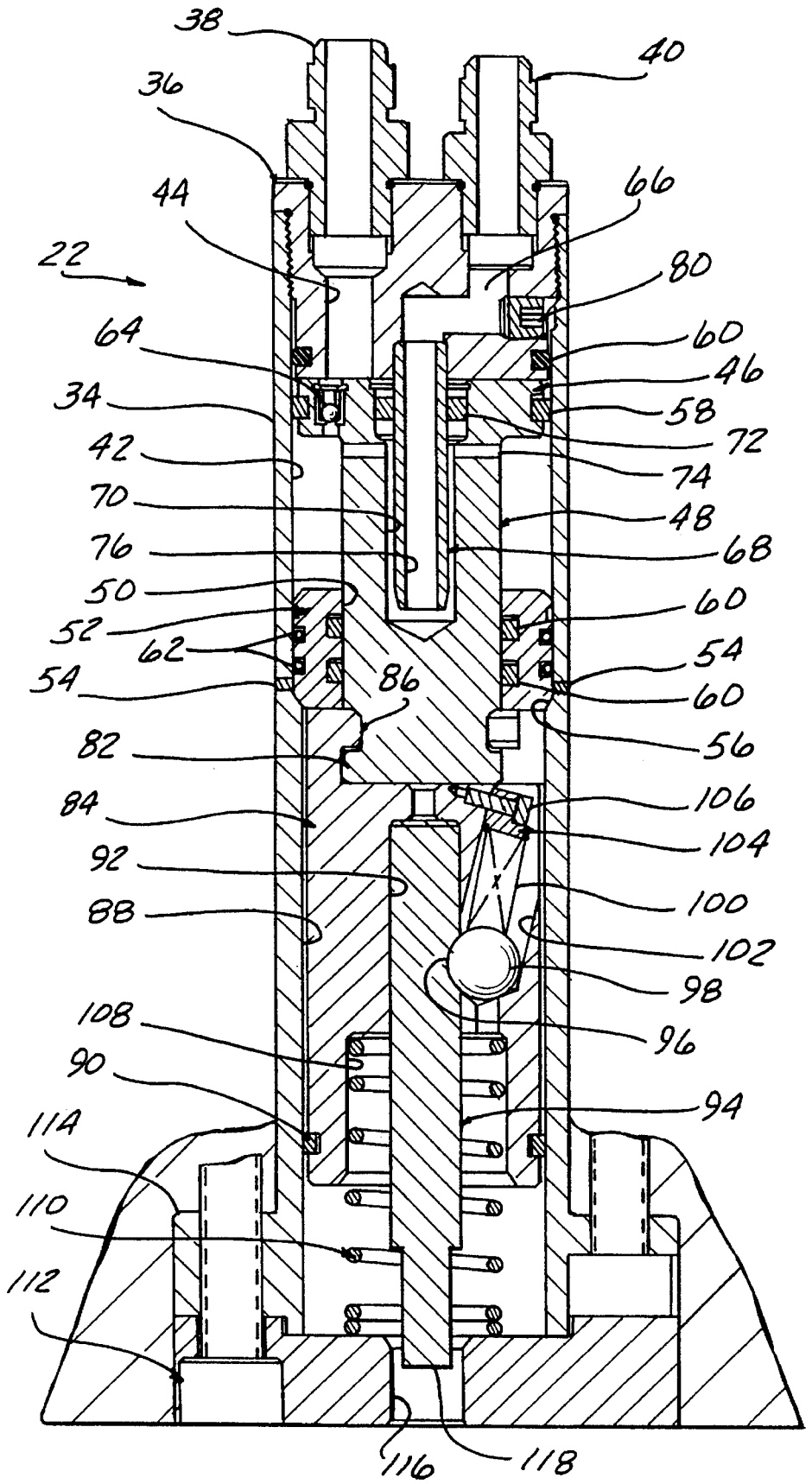
FIG. 2 is a longitudinal sectional view of an actuator-punch assembly according to the present invention.

The details of the actuator-punch assembly 22 may be seen by reference to FIG. 2. A housing cylinder 34 substantially completely encloses both the punch tooling and hydraulic actuation components an end cap 36 is threaded into the upper end of the housing cylinder 34 and sealed with o-ring 36 and has an inlet hydraulic fitting 38 and return hydraulic fitting 40 threaded therein.

Inlet fitting 38 is aligned with a supply passage 44 formed in the end cap 36, which extends to the upper face of a piston 46 having a seal 58 slidable in bore 42 defined in the upper end of housing cylinder 34. The piston 46 is in turn integral with a piston rod 48 extending axially through the bore 42 and through a bore 50 and a rod seal gland 52 fixed within the cylinder bore 42 held by set screws 54 in position against a shoulder 56 formed in the cylinder housing bore 42.

The piston 46 is provided with a pair of seals 60 held in the rod seal gland 52 to seal the piston rod 48. The rod seal gland 52 is provided with O-rings 62 in order to render the space between the rod seal gland 52 and the end cap 36 fluid tight against the hydraulic pressure developed therein.

A check valve orifice 64 is provided in a cross passage through the piston 46 for the purpose of establishing a slight purging flow through the hydraulic system as will be described hereinafter to eliminate the need for system bleeding to eliminate air bubbles therein.

The return fitting 40 is aligned with an offset passage 66 formed in the end cap 36 having a portion aligned with a return flow tube 68 located centered in the end cap 36 projecting through the center of the piston 46 and received in an axial bore 70 machined into the piston rod 48.

A suitable seal 72 engages the outside diameter of the tube 68. A series of radial openings 74 extend from the outer perimeter of the piston rod 48 and enter into the axial bore 70 in the in the piston rod 48.

A clearance space exists between the tube 68 and axial bore 70 to allow flow from the space in the bore 42 defined beneath the piston 46 through the radial passages 74 and into an internal passage 76 defined by the tube 68. The flow passing around an axial clearance between the end of tube 68 and the bottom of bore 70 as shown.

The offset passage 66 is closed off by a plug 80 after machining of the radial portion of the offset passage 66.

The piston rod 48 has an end portion projecting through the rod seal gland 52, the end portion 82 formed with a T-shape such as to mate with the upper end of a punch retainer 84 having a complementarily shaped seat portion 86.

The punch retainer 84 is slidable in a bore 88 defined by the lower portion of the housing cylinder 34. A seal 90 prevents the entrance of dirt and capturing any leakage past the rod seal gland 52.

The punch retainer 84 is formed with a bore 92 adapted to receive a punching tool 94. A punching tool is formed with a notch 96 engaged by a punch retainer wall 98, urged into engagement with a punch retainer spring 100 contained in an inclined bore 102 machined into the punch retainer 84. A punch retainer fitting 104 is mounted by a cap screw 106 and punch spring retainer plate 104.

A counterbore 108 in the lower end of the punch retainer 84 receives one end of a return spring 110, the opposite end engaging the upper face of a punch stripper 112.

The return spring 110 is for the purpose of holding punch retainer in its retracted position during handling and assembly only, as the punching and return strokes are carried out hydraulically.

A cylinder housing flange 114 is provided for mounting the punch assembly to the upper die 12 by means of cap screws. The stripper punch 112 in turn is mounted by cap screws to the mounting flange 114.

The punch stripper has a central bore 116 receiving the punch end 118.

Figure 2A:
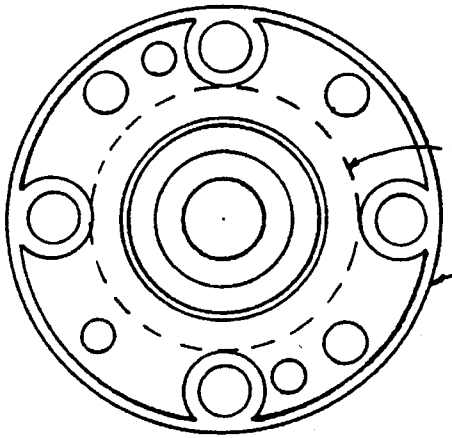
FIG. 2A is an end view of the actuator punch assembly shown in FIG. 2.

FIG. 2A shows that the actuator-punch assembly 22 is comprised of cylindrical parts such that it is relatively easily mounted in the die 12 by boring a suitable seat in the die.

Figure 3:
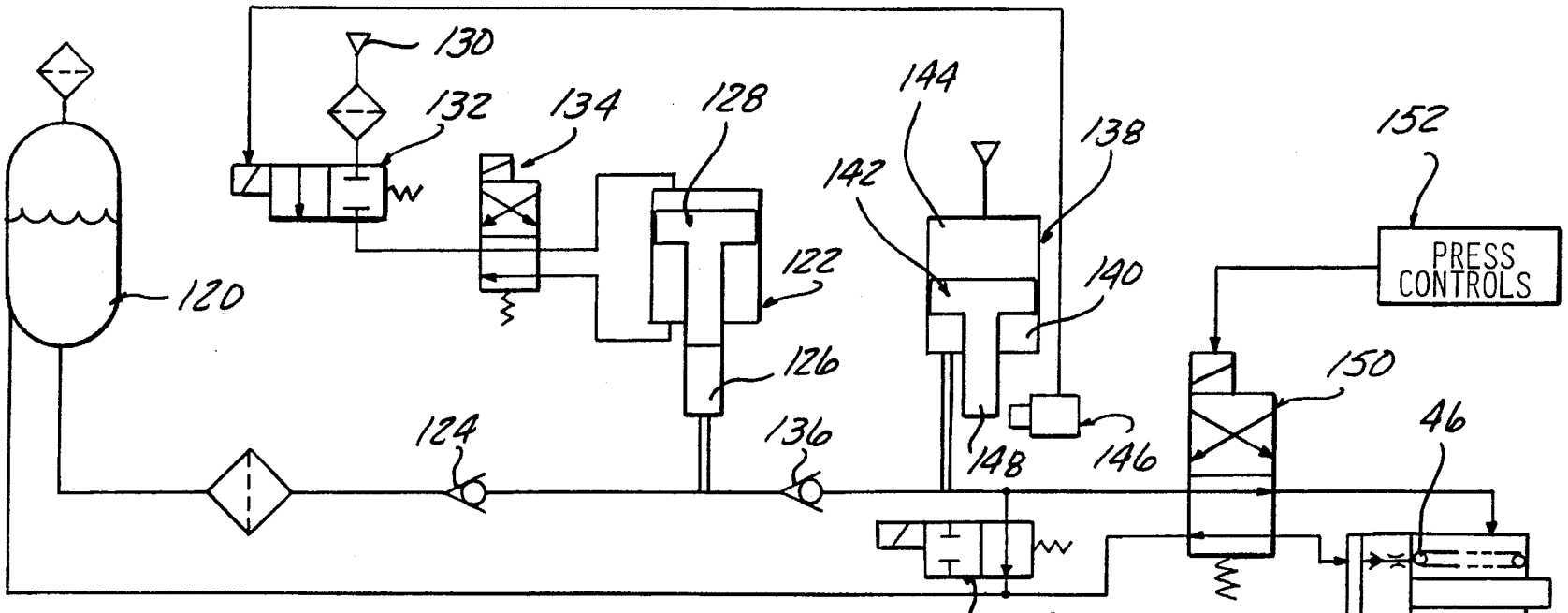
FIG. 3 is a diagrammatic representation of the supply circuit for the actuator punch assembly according to the present invention.

FIG. 3 illustrates diagrammatically the preferred source of pressurized hydraulic fluid for operation of the actuator punches 22. Hydraulic fluid is contained in an unpressurized reservoir 120.

Reservoir 120 is in communication with a pressure booster 122 via a check valve 124. A small diameter cylinder 126 adapted to be pressurized by downward movement of a large diameter piston 128 by means of air pressure received from an air pressure source 130.

A solenoid valve 132 and switching valve 134 allowing controlled cyclical application air pressure to the large diameter piston 128 to pump hydraulic fluid contained in the small diameter chamber 126 to an accumulator 138 via check valve 136. The accumulator has a lower chamber 140 receiving pressurized hydraulic fluid from cylinder 126 causing a piston 142 to be raised against the force developed by pressurized nitrogen gas in the upper chamber 144.

An indicator switch 146 is associated with a small diameter piston rod 148 protruding from the accumulator which detects the position of the piston 142 to ensure that a sufficient volume pressurized hydraulic fluid has been generated to operate the punches 22. A signal from switch 116 controls the solenoid 132 to activate the same whenever the available volume declines below that required.

Hydraulic fluid under pressure is communicated by means of a switching solenoid valve 150 to pressurize the actuating piston assembly in either a punching or retracting direction of the punching tool when the press controls 152 generate a signal calling for a particular piercing operation.

A safety pressure release solenoid valve 154 enables dumping of the stored pressurized hydraulic fluid back to the hydraulic fluid reservoir 120 whenever the machine is not in operation.

The check valve-orifice 64 in piston 46 creates a net flow towards the reservoir 120 with each stroke, since a slight flow back to the reservoir is allowed during the return stroke. This allows bubbles to be carried back to the unpressurized reservoir 120 where they can pass out of the fluid. Thus, no bleeding is necessary.

Figure 4A:
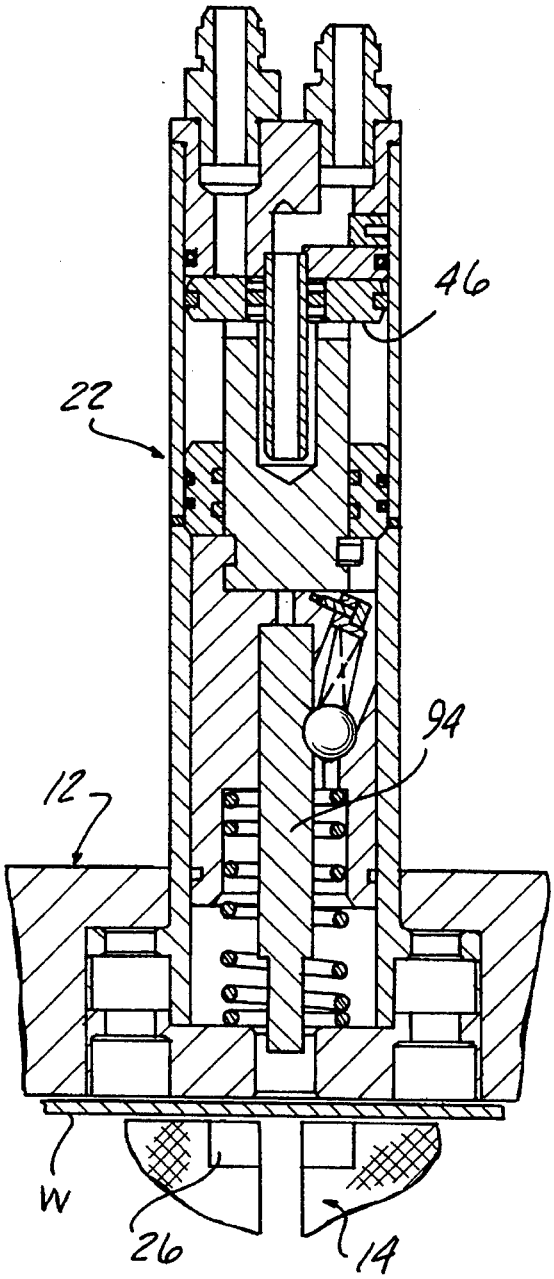
FIGS. 4A–4D are sectional views of the actuator-punch assembly shown in FIG. 2 with a fragmentary sectional view of the associated die portions, shown in successive stages of operation.

FIG. 4A shows the actuator-punch assembly 22 prior to actuation with the punching tool 94 retracted and piston 46 in the raised position. A workpiece W in position between the upper die 12 and lower die 14.

Figure 4B:
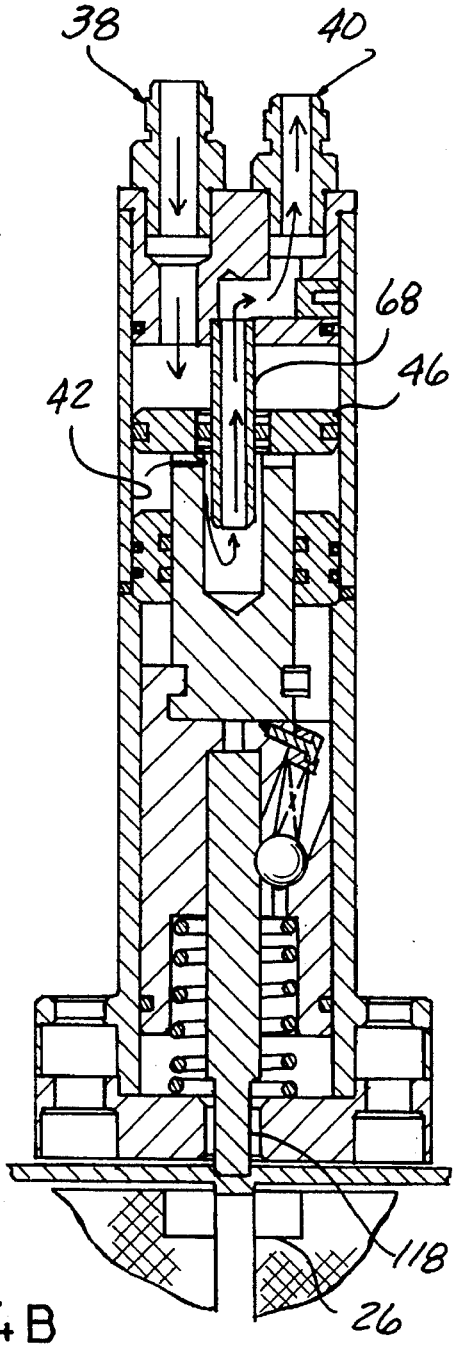

In FIG. 4B, the piston 46 has been stroked downwardly by the introduction of fluid pressure through the supply fitting 38. The fluid displaced by movement of the piston 46 in the bore 42 below the piston 46 is displaced through the tube 68 out the return fitting 40.

The end 118 of the punching tool has begun to penetrate the workpiece W which is forced into the stamping punching die 26.

Figure 4C:
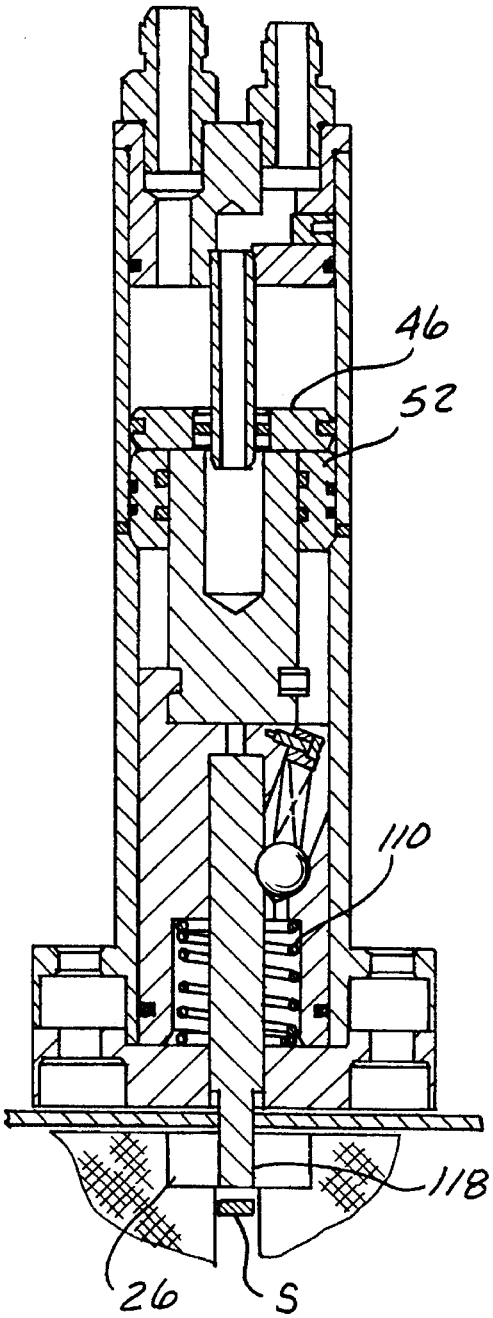

FIG. 4C shows the completion of the punching stroke in which the punching end 118 has been received within the punching die 26 and the slug S displaced through the die 26 as the piston 46 reaches position abutting the rod seal gland 52. The return spring 110 is fully compressed.

Figure 4D:
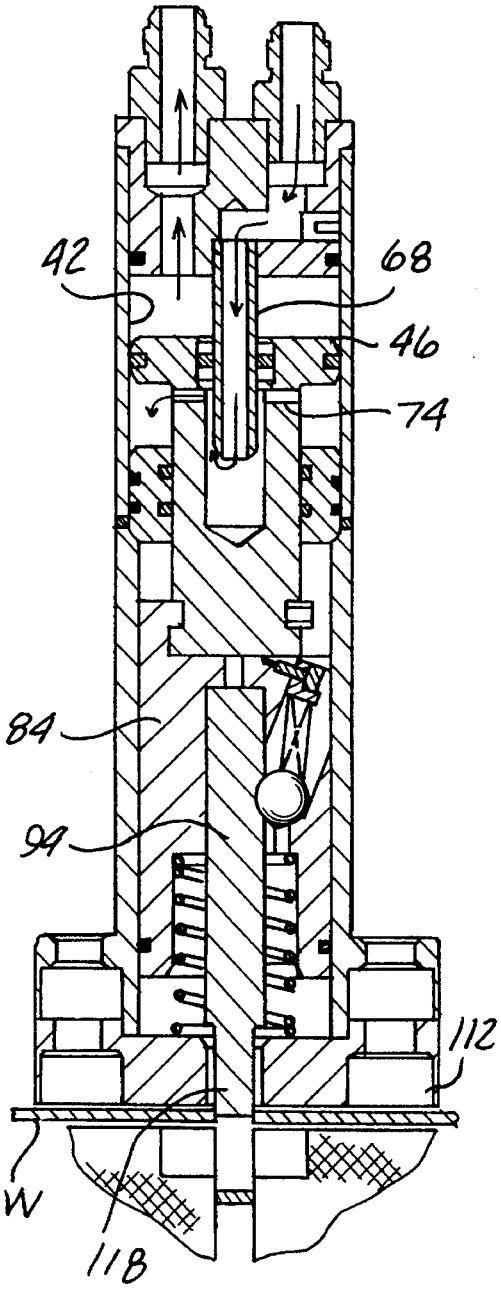

FIG. 4D shows the beginning of the return stroke which the stripper 112 remains in position against the workpiece W as the piston 46 is retracted, the punch retainer 84 being pulled upwardly to retract the punch tool 94 such that the punch end 118 is stripped from the workpiece W to complete the punching process. In this instance, fluid under pressure is introduced in through the tube 68 passing out radial holes 74 into the space defined in the bore 42 beneath the piston 46 to cause the upward stroking whereas fluid is displaced from the bore 42 in the space above the piston 46.

I claim:

1. A forming die arrangement for forming a sheet material workpiece comprising an upper die and a lower die adapted to be driven together in a press to form said workpiece interposed therebetween;

at least one actuator-punch assembly recessed into one of said dies, said actuator-punch assembly including a double acting hydraulic cylinder actuator arranged to drive a punch to pierce an opening through said workpiece after completion of the forming of said workpiece;

said hydraulic cylinder including a piston slidable in a cylinder with pressure chambers defined on either side of said piston, said piston drivingly connected to said punch to enable piercing of said workpiece upon pressurization of one of said chambers and advance stroking of said piston, and withdrawal of said punch upon pressurization of the other of said chambers and return stroking of said piston;

a hydraulic fluid pressure circuit connected to said hydraulic cylinder actuator to enable operation thereof, said hydraulic circuit including a pressure source and a low pressure reservoir, and valving alternately connecting the one or the other of said chambers to said pressure source or said reservoir respectively to cause advance and return stroking of said piston; and a one way acting restriction through said piston allowing restricted flow past said piston only from said other chamber to said one chamber to allow limited hydraulic fluid flow to said reservoir during return stroking of said piston to thereby allow air bubbles to be carried back to said reservoir to be purged from said circuit.

2. The forming die arrangement according to claim 1 wherein said actuator-punch assembly includes an elongated cylinder housing having said piston slidable in a cylinder actuator housing bore at one end, and a punch retainer slidable within said cylinder housing bore at the other end thereof, a piston rod connecting said piston to said punch retainer to be slidable therewith, said punch retainer configured to mount a punch to be driven outwardly from said other end of said cylinder housing.

3. The forming die arrangement according to claim 2 further including an end cap mounted within said one end of said cylinder housing and defining a pressure chamber with one side of said piston, said end cap having supply and return hydraulic connections for communicating hydraulic circuit to respective sides of said piston; said end cap having a tube communicating with said return hydraulic fitting and extending through one side of said piston to the other side thereof within an axial bore in said piston rod; and, one or more radial openings communicating the inside of said tube to a space on said other side of said piston to enable flow of hydraulic fluid to and from said return connection.

4. The forming die arrangement according to claim 3 wherein said tube is slidable in a bore in said piston and sealed therein.

5. The forming die arrangement according to claim 4 wherein said piston rod bore is larger in diameter and longer in length than said tube to create a clearance space receiving flow to or from said tube.

6. The forming die arrangement according to claim 1 further including a punch die recessed into the other die and aligned with said actuator-punch assembly in said one die to receive said punch upon piercing of said workpiece.

7. The forming die arrangement according to claim 1 wherein said actuator punch assembly includes a stripper piece attached to said other end of said cylinder housing and engaging said workpiece during withdrawal of said punch tool after piercing of said workpiece.

8. The forming die arrangement according to claim 1 wherein said hydraulic circuit pressure source includes accumulator means pressurizing hydraulic fluid by movement of an accumulator element and further includes a switch associated with said accumulator element indicating a charged condition of said accumulator.

9. The forming die arrangement according to claim 1 further including a disconnect coupling attached to said one die connecting hydraulic lines to said actuating-punch assembly.

* * * * *